US005921185A

United States Patent [19]

Hoyon et al.

[11] Patent Number: 5,921,185

[45] Date of Patent: Jul. 13, 1999

[54] BODY-TILT SYSTEM FOR ARTICULATED VEHICLES, A VEHICLE INCLUDING SUCH A SYSTEM, AND A SET OF SUCH VEHICLES

[75] Inventors: Christophe Hoyon, Ferrieres; Jean-Claude Gaiguant, Chatelaillon; Michel Cros, La Jarne, all of France

[73] Assignee: GEC Alsthom Transport SA, Paris, France

[21] Appl. No.: 08/859,909

[22] Filed: May 21, 1997

[30] Foreign Application Priority Data

May 22, 1996 [FR] France ..... 96 06344

[51] Int. Cl.[6] ..... B60D 7/00

[52] U.S. Cl. ..... 105/4.1; 105/199.1; 105/199.2

[58] Field of Search ..... 105/3, 4.1, 4.2, 105/4.3, 8.1, 176, 199.1, 199.2, 202, 203, 200

[56] References Cited

U.S. PATENT DOCUMENTS

| | | | |
|---|---|---|---|
| 2,225,242 | 12/1940 | Van Dorn et al. | 105/4.1 |
| 3,002,470 | 10/1961 | Flowers | 105/4.1 |
| 4,953,472 | 9/1990 | Tutzer | 105/4.3 |
| 4,981,083 | 1/1991 | Cripe | 105/4.3 |
| 5,343,812 | 9/1994 | Ishida | 105/4.3 |
| 5,671,683 | 9/1997 | Parussatti et al. | 105/199.2 |

FOREIGN PATENT DOCUMENTS

| | | | |
|---|---|---|---|
| 347334 | 12/1989 | European Pat. Off. | 105/4.3 |
| 0683081A1 | 11/1995 | European Pat. Off. . | |
| 1539860 | 9/1968 | France . | |
| 2108551 | 5/1972 | France . | |

*Primary Examiner*—Mark T. Le
*Attorney, Agent, or Firm*—Sughrue, Mion, Zinn, Macpeak & Seas, PLLC

[57] ABSTRACT

A system enables two vehicles to tilt at different angles, wherein one of the vehicles includes a supporting end and the other vehicle includes a supported end, where the vehicle having the supporting end and the vehicle having the supported end are associated with a bogey. A supported ring is used with the supported end of the vehicle in such a manner that rotation is possible between the supported ring and the vehicle having the supported end.

18 Claims, 5 Drawing Sheets

BODY-TILT SYSTEM FOR ARTICULATED VEHICLES, A VEHICLE INCLUDING SUCH A SYSTEM, AND A SET OF SUCH VEHICLES

The present invention relates to tilting the bodies of vehicles in general, and in particular of rail vehicles, and more particularly the invention relates to a system enabling two vehicles to be at different tilt angles. The invention also relates to a vehicle including such a system and to a set of such vehicles.

BACKGROUND OF THE INVENTION

An advantage of body-tilt vehicles is that they enable travel times to be reduced on the existing, non-high speed rail network, which network includes curves having a radius of less than 3000 meters (m).

Another advantage of body-tilt vehicles is an improvement in passenger comfort, in particular on sinuous lines, because the passengers are not subjected to transverse displacements.

Prior art articulated train-sets travel on intermediate bogeys which are not active in controlling tilting.

A consequence is that the speed with which a curve can be taken is defined by the cant of the track and its radius of curvature.

OBJECTS AND SUMMARY OF THE INVENTION

Thus an object of the invention is to provide a body-tilt system for a vehicle that is based on a novel principle.

Another object of the invention is to provide a body-tilt system capable of being implemented on articulated train-sets.

According to the invention, in the system enabling two vehicles to tilt at different angles, one of the vehicles includes a supporting end and the other vehicle includes a supported end, said vehicle having a supporting end and said vehicle having a support end being associated with a bogey, a supported ring being associated with said supported end of said vehicle in such a manner that rotation is possible between said supported ring and said vehicle having the supported end. The use of the terms "support ring" and "supported ring" are synonymous in the context to the present disclosure.

The system of the invention enabling two vehicles to tilt at different angles also satisfies at least one of the following characteristics:

- said rotation between said supported ring and said vehicle having a supported end is obtained by means of rotary guide elements disposed between said supported ring and said supported end of said vehicle;
- said supported ring rests on an articulation;
- said supported ring of said vehicle rests on said articulation via a supported cross-member secured to said supported ring;
- said supported ring is disposed at the end of said vehicle having the supported end; and
- said supported ring is disposed between said vehicle having a supported end and said vehicle having a supporting end.

In a first preferred embodiment, the device of the invention enabling two vehicles to tilt at different angles satisfies at least one of the following characteristics:

- said articulation rests on a supporting cross-member secured to the supporting end of said vehicle having a supporting end;

- said supporting cross-member of said supporting end of said vehicle rests directly on the secondary suspension of said intermediate bogey;
- said bogey includes a supporting cross-member that is movable so as to tilt said vehicle having a supporting end, said movable supporting cross-member being guided relative to a guide cross-member by means of tilt guide elements; and
- said vehicle having a supporting end is controlled from said bogey by means of a tilt control device secured to said supporting cross-member and to said guide cross-member.

In another embodiment, the system of the invention enabling two vehicles to tilt at different angles satisfied at least one of the following characteristics:

- said articulation rests on a supporting cross-member of a supporting ring, said supporting ring being associated with the supporting end of said vehicle;
- said supporting cross-member of said supporting ring rests directly on the secondary suspension of said intermediate bogey;
- rotation between said supporting ring and said vehicle having a supporting end is obtained by means of rotary guide elements disposed between said supporting ring and said supporting end of said vehicle;
- a first tilt control device for said supported end of said vehicle is disposed between the end of the body of said vehicle and said associated supported ring; and
- a second tilt control device of said supporting end of said vehicle is disposed between the end of the body of said vehicle and said associated supporting ring.

The system of the invention enabling two vehicles to tilt at different angles also satisfies the characteristic whereby the center of rotation of said system is situated above the center of gravity of said vehicle with which it is associated.

According to another characteristic of the invention, the set of vehicles or the vehicle, in particular a rail vehicle or vehicles, is such that each vehicle includes at least one system enabling two successive vehicles to have different angles of tilt.

Said set of vehicles or said vehicle of the invention also satisfies the characteristic whereby said system allowing two successive vehicles to tilt at different angles complies with any one of the above characteristics.

An advantage of the body-tilt system of the invention is that it can be fitted to existing vehicles without interfering with existing structures and without decreasing the width of said vehicles, while still satisfying the loading gauge thereof.

Another advantage of the body-tilt system of the invention is that it operates without jolting because of the small polar moment of inertia in the transverse plane.

Another advantage of the body-tilt system of the invention is that it requires little energy to operate it, given the small or zero distance between the center of gravity and the center of rotation.

Another advantage of the body-tilt system of the invention is that it does not apply twist to the structure of a vehicle in any possible body-tilt configuration.

Another advantage of the body-tilt system of the invention is that its center of gravity is situated beneath the center of rotation, thereby enabling the vehicle to return naturally to its initial position without being tilted, in the event of a failure in the control system.

Another advantage of the body-tilt system of the invention is that it requires no maintenance to enable it to operate.

BRIEF DESCRIPTION OF THE DRAWINGS

Other objects, characteristics, and advantages of the invention appear on reading the following description of preferred embodiments of the body-tilt system as applied to a tilting rail vehicle, which description is made with reference to the accompanying drawings, in which.

MORE DETAILED DESCRIPTION

Figure 1:
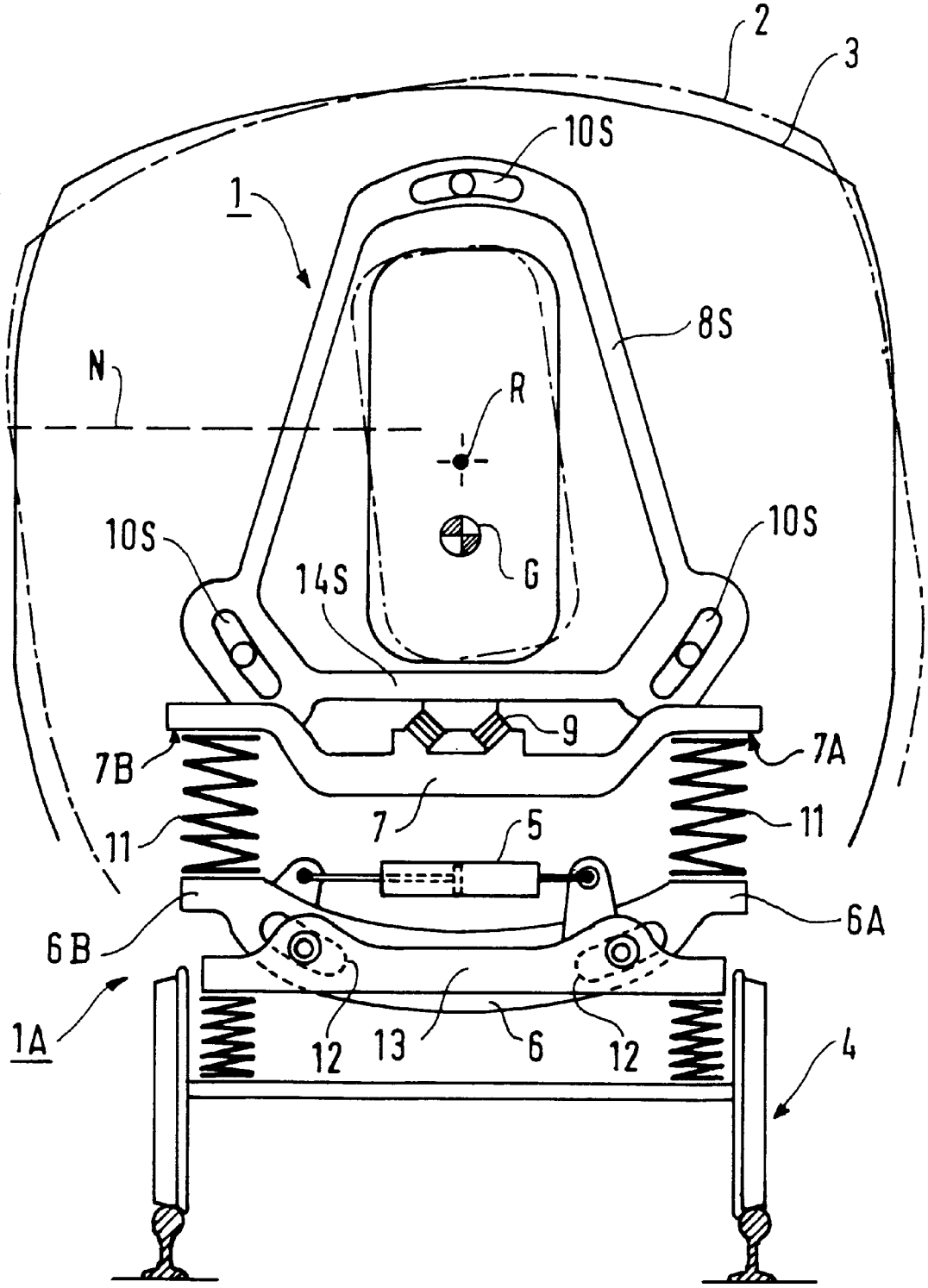
FIG. 1 is an end view of a first embodiment of the body-tilt system of the invention, the body-tilt system being installed in a rail vehicle.

FIG. 1 is an end view of a first embodiment of a body-tilt system of the invention.

The body-tilt system is implemented on a rail vehicle.

Figure 2:
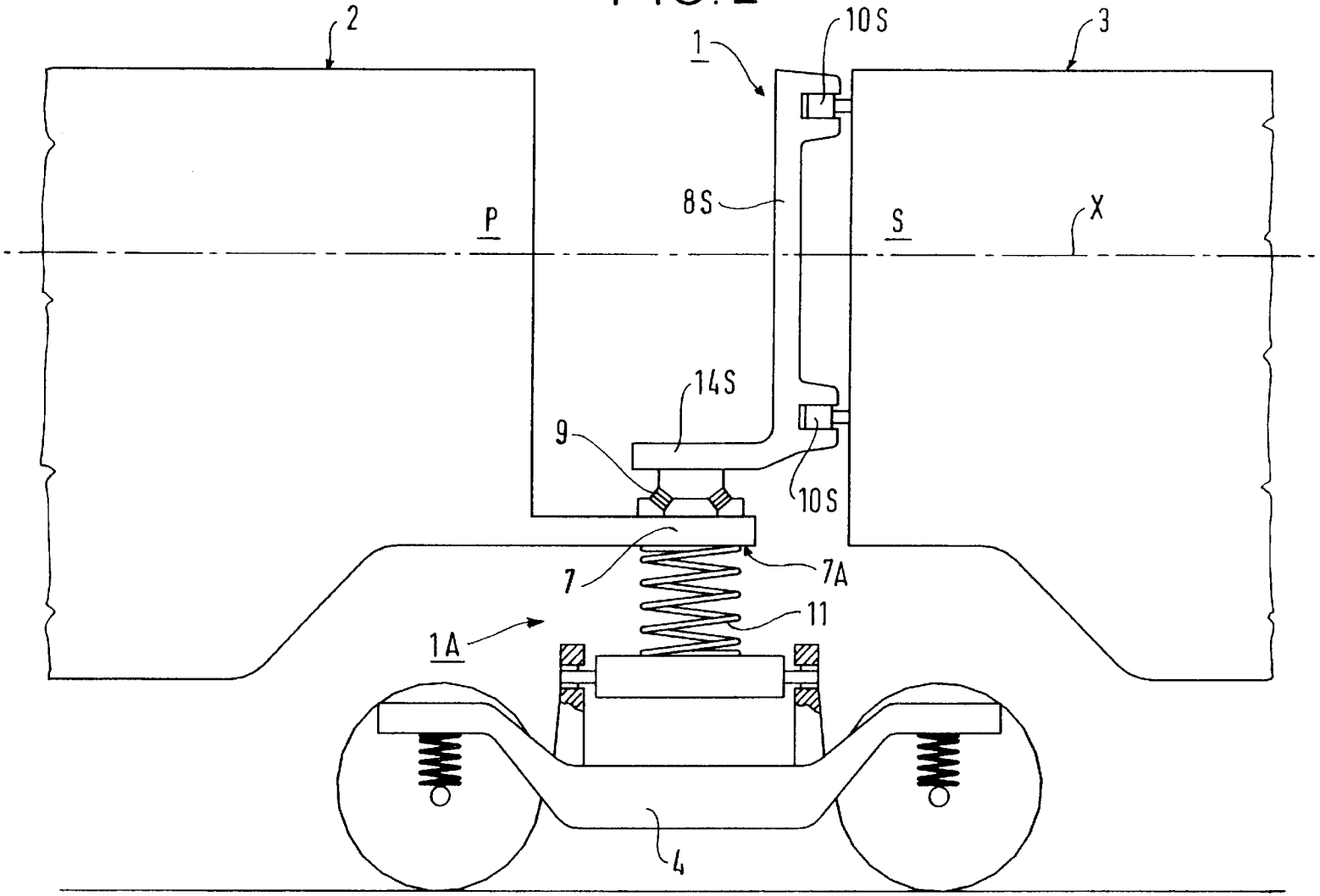
FIG. 2 is a side view of the FIG. 1 body-tilt system.

FIG. 2 is a side view of the FIG. 1 body-tilt system.

The body-tilt system 1A for a rail vehicle 2 is disposed at the end of the body of the rail vehicle 2 and can also be disposed between two successive rail vehicles 2, 3.

In a first preferred embodiment of the invention, the body-tilt system 1A is supported on an intermediate bogey 4 so as to form articulated elements.

It is possible to control the tilt of the vehicle 2 from its intermediate bogey by means of a tilt control device 5, e.g. an actuator.

When travelling round a curve, the intermediate bogey 4 tilts the vehicle 2 having a supporting end P towards the inside of the curve to compensate for the track having insufficient cant given the increased speed of travel round the curve.

A supporting cross-member 6 of the bogey 4 remains parallel to the top supports 7A and 7B of the vehicle 2 while moving up at one end 6A and down at the other end 6B so as to perform tilting. By remaining parallel to the supports 7A and 7B of the vehicle 2, the supporting cross-member 6 of the bogey 4 ensures that the suspension operates properly.

In accordance with the invention, the supporting cross-member 6 of the bogey 4 is capable of moving simultaneously in a transverse direction in order to center the vehicle better within the structure clearance gauge of the network.

This displacement is possible because of the presence of tilt guide elements 12 for guiding the supporting cross-member 6 relative to a guide cross-member 13 for the supporting cross-member 6 of the bogey 4.

The center of rotation R in tilting is positioned above the center of gravity G of the vehicles, at a height which is very close to the level N of the heads of seated passengers.

The supported end S of the vehicle 3 receives a supported ring 8S placed on an articulation 9, with the articulation resting on a supporting cross-member 7 secured to the supporting end P of the vehicle 2.

From the above, it results that rotation is possible between the supported ring 8S and the vehicle 3 having the supported end S, thereby enabling the vehicles 2 and 3 associated with the same intermediate bogey 4 to have different angles of tilt.

Such rotation is obtained by means of rotation guide elements 10S between the supported ring 8S and the supported end S of the vehicle 3.

Such rotation is of use in the event of the tilt control on the bogey failing, and also when passing over ramps of varying cant on entering and leaving curves.

In addition, rotation between the supported ring 8S and the supported end S in the vertical plane prevents the structure of the vehicle 3 being twisted.

In the horizontal plane, rotation of a vehicle 2 relative to another vehicle 3 and also the ability to pass over dips and humps is achieved at the articulation 9, e.g. by means of a ball-and-socket arrangement.

The supporting cross-member 7 of the supporting end P of the vehicle 2 rests directly on the secondary suspension 11 of the intermediate bogey 4.

The supported ring 8S of the vehicle 3 rests on the articulation 9 via a supported cross-member 14S.

Figure 3:
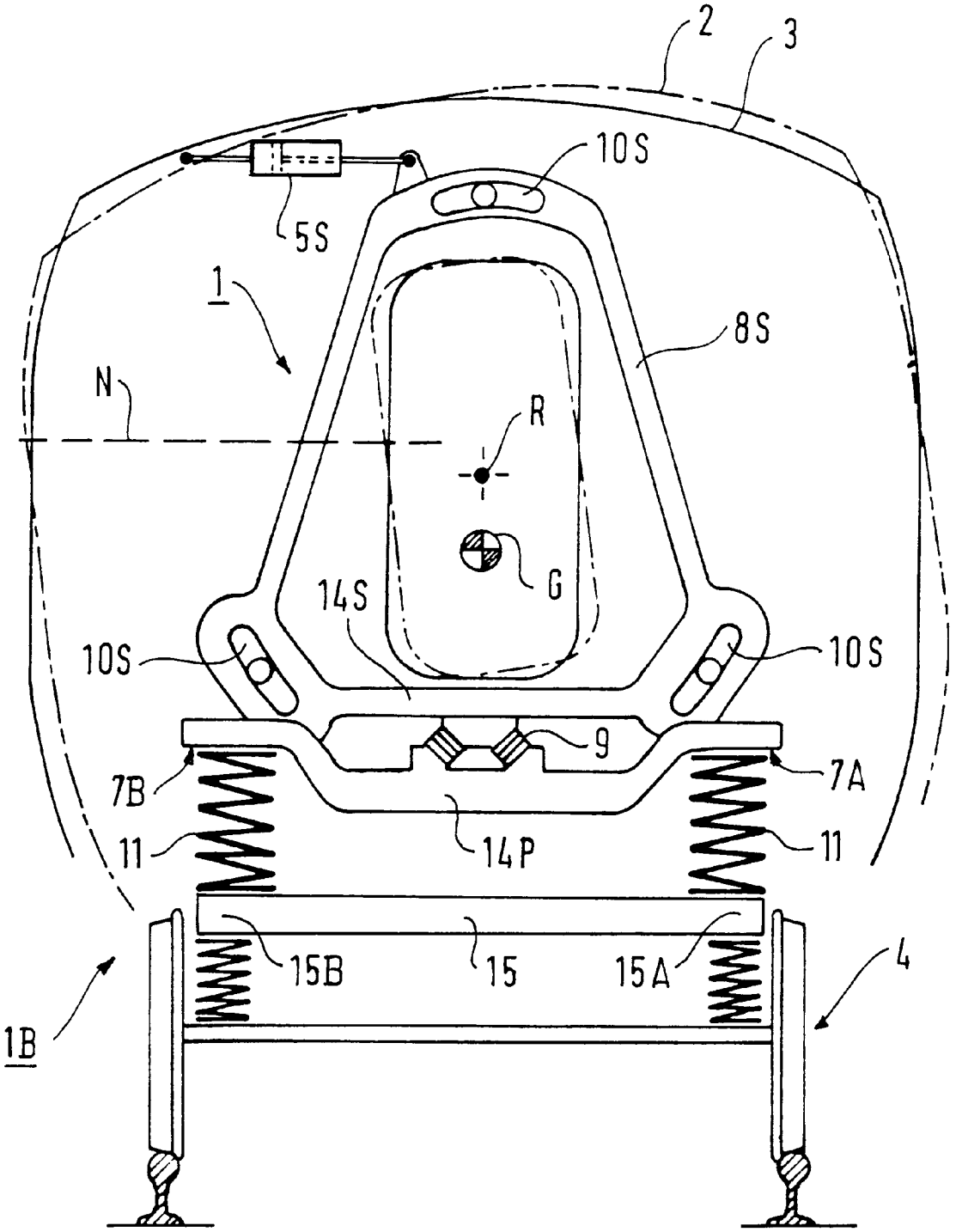
FIG. 3 is an end view of a second embodiment of the body-tilt system of the invention, the body-tilt system being implemented in a rail vehicle.

FIG. 3 is an end view of a second embodiment of a body-tilt system of the invention.

Figure 4:
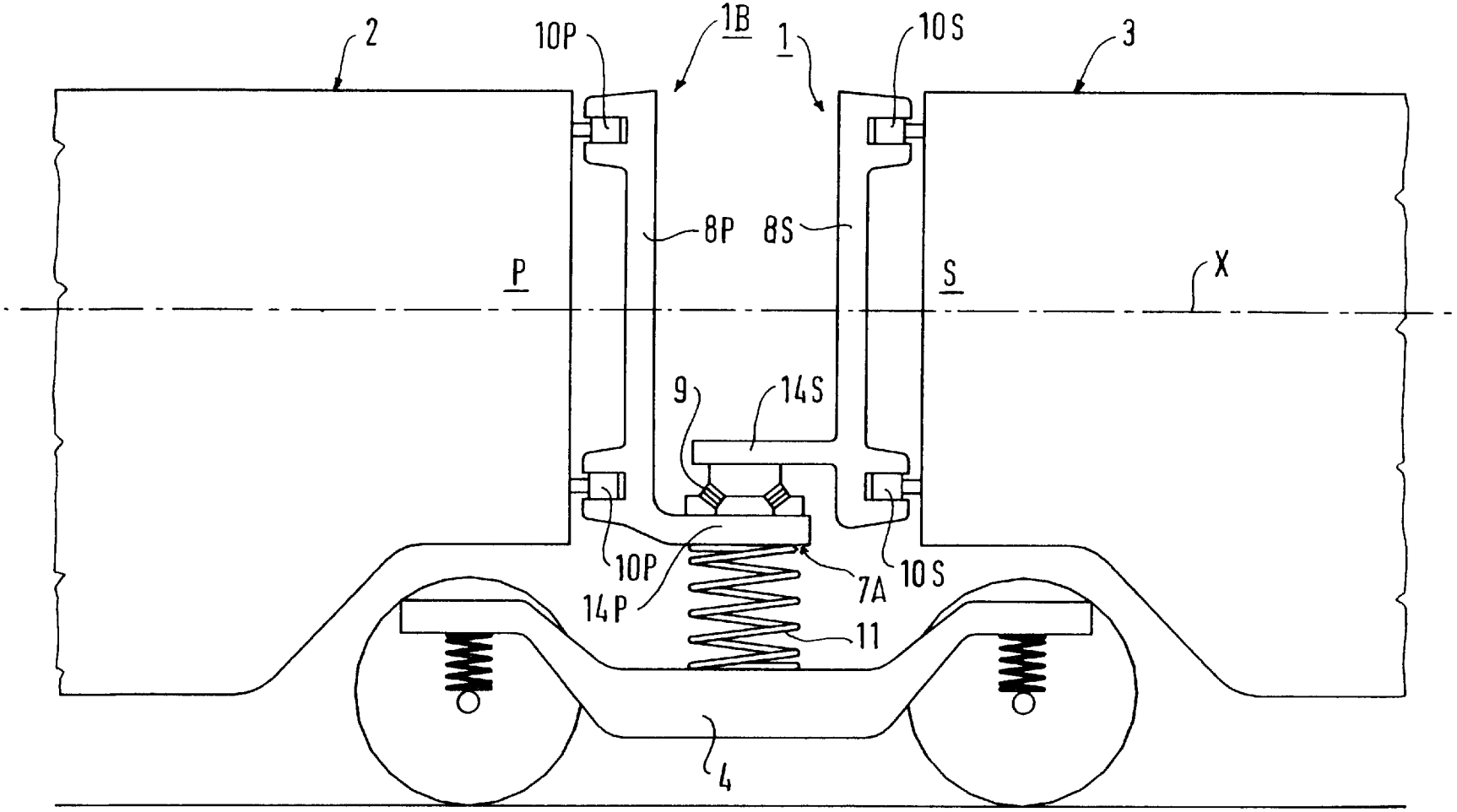
FIG. 4 is a side view of the FIG. 3 body-tilt system.

FIG. 4 is a side view of the FIG. 3 body-tilt system.

In this second embodiment, there are to be found a body-tilt system 1B for a rail vehicle 2, disposed at the end of the body of said rail vehicle 2 and likewise capable of being disposed between two rail vehicles 2, 3.

There are also to be found in this second embodiment, an intermediate bogey 4, top supports 7A and 7B for the vehicle 2, a supported ring 8S, and guide elements 10S for guiding the ring 8S in rotation on the supported end S, and an articulation 9.

In this second preferred embodiment of the invention, the body-tilt system 1B rests on the intermediate bogey 4 so as to form articulated elements.

The articulation 9 rests on a supporting cross-member 14P of a supporting ring 8P, the supporting ring 8P being associated with the supporting end P of the vehicle 2.

When travelling round a curve, the intermediate bogey 4 tilts the vehicle 2 including the supporting end P towards the inside of the curve so as to compensate for the track having insufficient cant, given the increased speed of travel round the curve.

A supporting cross-member 15 of the bogey 4 remains parallel to the top supports 7A and 7B of the vehicle 2 while lifting one end 15A and lowering its other end 15B so as to tilt the body. By remaining parallel to the supports 7A and 7B of the vehicle 2, the supporting cross-member 15 of the bogey 4 ensures that the suspension operates properly.

The center of rotation R for tilting is positioned above the center of gravity G of the vehicles at a height which is very close to the level N of the heads of seated passengers.

As before, the supported end S of the vehicle 3 receives the supported ring 8S placed on the articulation 9 via the supported cross-member 14S of the supported ring 8S.

Rotation is possible between the supported ring 8S and the vehicle 3 having the supported end S, and it is also possible between the supporting ring 8P and the vehicle 2 that has the supporting end P so as to allow the vehicles 2 and 3 which are associated with a common intermediate bogey 4 to have different angles of tilt.

This rotation is made possible by the fact that guide elements 10S are present for guiding rotation of the supported ring 8S, and also because of the presence of guide elements 10P for guiding the supporting ring 8P in rotation.

The guide systems 10S and 10P for guiding the supported ring 8S and the supporting ring 8P respectively in rotation are themselves secured respectively to the supported end S and to the supporting end P of the vehicles 3 and 2, respectively.

Such rotation is useful in the event of the tilt control on a bogey failing, and also when travelling over ramps of varying cant when entering and leaving curves.

As before, rotation between the supported ring 8S and the supported end S, and also rotation between the supporting ring 8P and the supporting end P in the vertical plane serves to avoid applying twist to the structure of the vehicles 3 and 2.

In the horizontal plane, rotation of a vehicle 2 relative to another vehicle 3, and also the ability to pass over dips and humps is achieved at the articulation 9, e.g. by means of a ball-and-socket arrangement.

The supporting cross-member 14P of the supporting ring 8P rests directly on the secondary suspensions 11 of the intermediate bogey 4.

The supported cross-member 14S of the supported ring 8S rests on the supporting cross-member 14P of the supporting ring 8P via the articulation 9.

Tilting of the vehicles 2 and 3 is controlled from within their own structures.

In other words, the intermediate bogey 4 does not receive any special adaptation for tilting.

A first tilting control device 5S at the supported end S of the vehicle 3 can be disposed between the end of the body of the vehicle 3 and the supported ring 8S associated with said vehicle 3.

Similarly, a second control device (not shown) for controlling tilting at the supporting end 2 of the vehicle 2 can be disposed between the end of the body of the vehicle 2 and the supporting ring 8P associated with said vehicle 2.

Each vehicle body thus includes a supported ring 8S, a supporting ring 8P, a first control device 5S, and a second control device, the supported end S including the supported ring 8S and the associated first control device 5S, and the supporting end P including the supporting ring 8P and the associated second control device.

The same control instructions (not shown) are applied to both control devices associated with the same vehicle.

The vehicle tilts on its two associated rings about a horizontal axis X that passes through the tilting rotation centers R.

The tilting rotation centers R of vehicles in the first embodiment and in the second embodiment are preferably situated at the same height.

Figure 5:
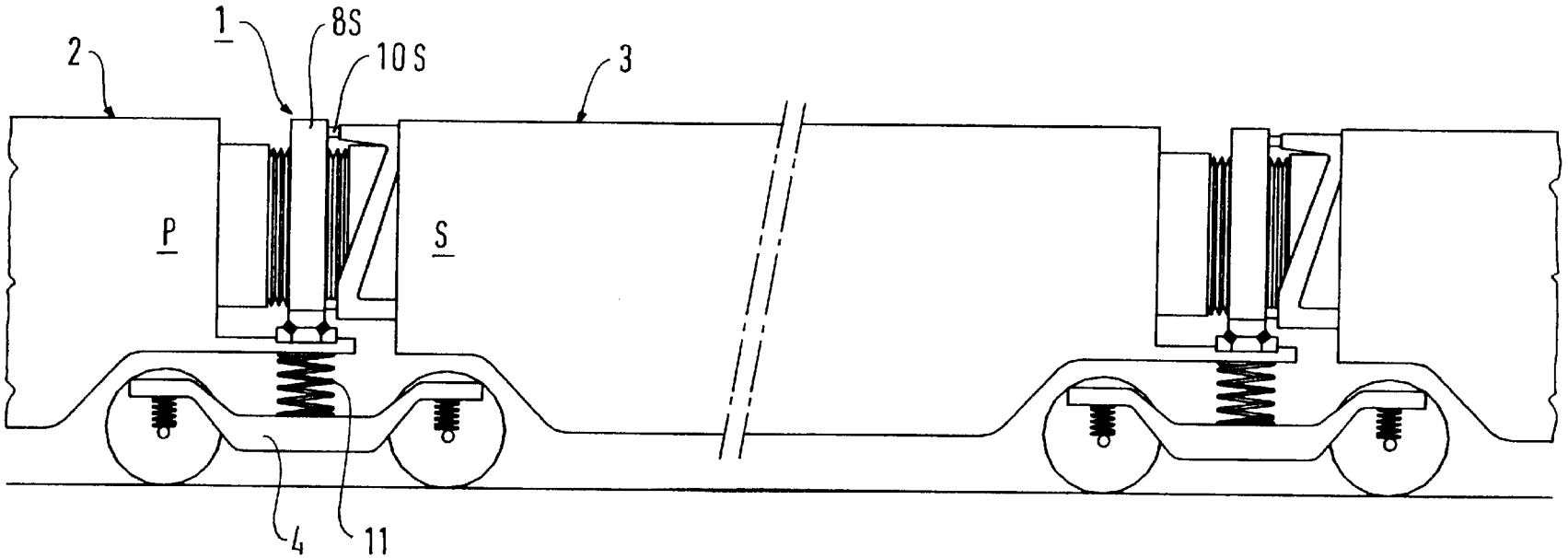
FIG. 5 is a side view of a rail vehicle having a body-tilt system and a connecting gangway at each end.

FIG. 5 is a side view of a rail vehicle including a body-tilt system at each end together with a connecting gangway.

To go from one vehicle to another, passengers pass through the supported ring 8S, possibly through the supporting ring 8P of the body-tilt system 1. The supported ring 8S and its system of rotation 10S are strong enough to connect a set of several vehicles.

It is clear that the body-tilt system of the invention for a rail vehicle can be implemented on a high speed train, a rail car, an underground railway, or indeed a tramway, or on any vehicle that requires tilting.

The body-tilt system is such that its center of rotation is located at a height that makes it possible to avoid reducing the width of existing vehicles.

The body-tilt system of the invention increases the "hours of comfort" characteristic of seated travellers because the center of rotation is situated close to the level of the heads of seated passengers.

Such an advantage does not exist in a non-tilting vehicle or in a vehicle in which the body-tilt system is situated below the level of the vehicle frame.

As mentioned above, the body-tilt system of the invention does not stress the structure of the vehicle under any circumstances.

Each vehicle remains independent from any other vehicle because the end of the structure can rotate in the vertical plane in which it is supported.

In an embodiment that is not shown, it is possible to associate the system that allows two vehicles sharing an intermediate bogey to have different angles of tilt to be applied likewise to vehicles that share a non-intermediate bogey.

We claim:

1. A system enabling two vehicles to tilt at different angles, wherein a first vehicle has a supporting end and a second vehicle has a supported end, where the first and second vehicles are connected to a bogey, and a support ring is connected to said bogey and connected to said supported end of said second vehicle in such a manner that rotation is possible between said support ring and said second vehicle.

2. A system according to claim 1, in which said rotation between said support ring and said second vehicle is obtained by means of rotary guide elements disposed between said support ring and said supported end of said second vehicle.

3. A system according to claim 1, in which said support ring rests on an articulation connected to the supporting end of said first vehicle.

4. A system according to claim 3, in which said support ring rests on said articulation via a supported cross-member section of said support ring.

5. A system according to claim 1, in which said support ring is disposed at the end of said second vehicle.

6. A system according to claim 1, in which said support ring is disposed between said second vehicle and said first vehicle.

7. A system according to claim 3, in which said articulation rests on a supporting cross-member secured to the supporting end of said first vehicle.

8. A system according to claim 7, in which said supporting cross-member of said supporting end of said first vehicle rests directly on a secondary suspension of said bogey.

9. A system according to claim 1, in which said bogey includes a supporting cross-member that is movable so as to tilt said first vehicle, said movable supporting cross-member being guided relative to a guide cross-member by means of tilt guide elements.

10. A system according to claim 9, in which the tilt of said first vehicle is controlled from said bogey by means of a tilt control device secured to said supporting cross-member and to said guide cross-member.

11. A system according to claim 1, in which an articulation rests on a supporting cross-member of an additional support ring, said additional support ring connected to the supporting end of said first vehicle.

12. A system according to claim 11, in which said supporting cross-member of said additional support ring rests directly on a secondary suspension of said bogey.

13. A system according to claim 11, in which rotation between said additional support ring and said first vehicle is obtained by means of rotary guide elements disposed between said additional support ring and said supporting end of said first vehicle.

14. A system according to claim 11, in which a first tilt control device for said supported end of said second vehicle is disposed between an end of said second vehicle proximate to said supported end and said support ring.

15. A system according to claim 11, in which a second tilt control device for said supporting end of said first vehicle is disposed between an end of said first vehicle proximate to said supporting end and said additional support ring.

16. A system according to claim 1, in which a center of rotation of said system is situated above the center of gravity of said first and second vehicles.

17. A system according to claim 1, wherein physical passage between said two vehicles is through said support ring.

18. A set of articulated vehicles, each vehicle having a system enabling two vehicles to tilt at different angles, wherein a first vehicle has a supporting end and a second vehicle has a supported end, where the first and second vehicles are connected to a bogey, and a support ring is connected to said bogey and connected to said supported end of said second vehicle in such a manner that rotation is possible between said support ring and said second vehicle.

* * * * *